United States Patent [19]

Berger

[11] 4,371,093

[45] Feb. 1, 1983

[54] VENDING MACHINE WITH CONVERTIBLE SHELVES

[76] Inventor: Martin M. Berger, 7711 Sycamore Ave., Elkins Park, Pa. 19117

[21] Appl. No.: 254,227

[22] Filed: Apr. 14, 1981

[51] Int. Cl.[3] ..... B65H 31/20

[52] U.S. Cl. ..... 221/90; 221/241

[58] Field of Search ..... 221/93, 242, 94, 90, 221/241, 125; 133/4 R

[56] References Cited

U.S. PATENT DOCUMENTS 2,896,817 7/1959 Holstein .

3,613,947 10/1971 Verbeke .

*Primary Examiner*—Stanley H. Tollberg

*Attorney, Agent, or Firm*—Seidel, Gonda, Goldhammer & Panitch

[57] ABSTRACT

A vending machine containing horizontal pivotable shelves disposed side-by-side are adapted to support articles to be dispensed. A device is disclosed for selectively converting two adjacent shelves so that they function as a single shelf whereby an operator can simultaneously attain dispensing from the two adjacent shelves.

8 Claims, 8 Drawing Figures

FIG. 4
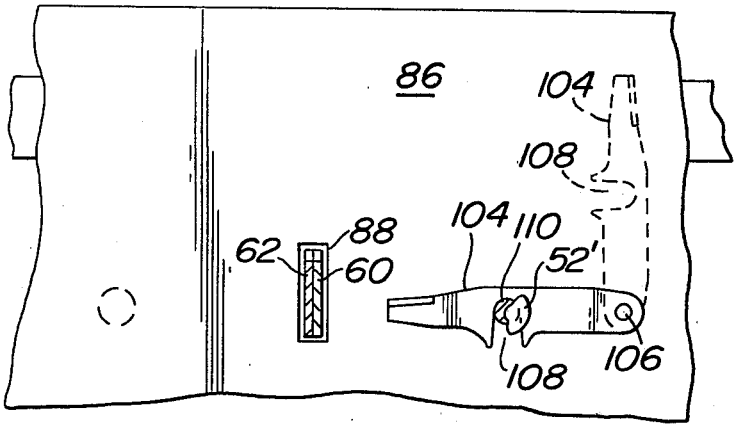
FIG. 5
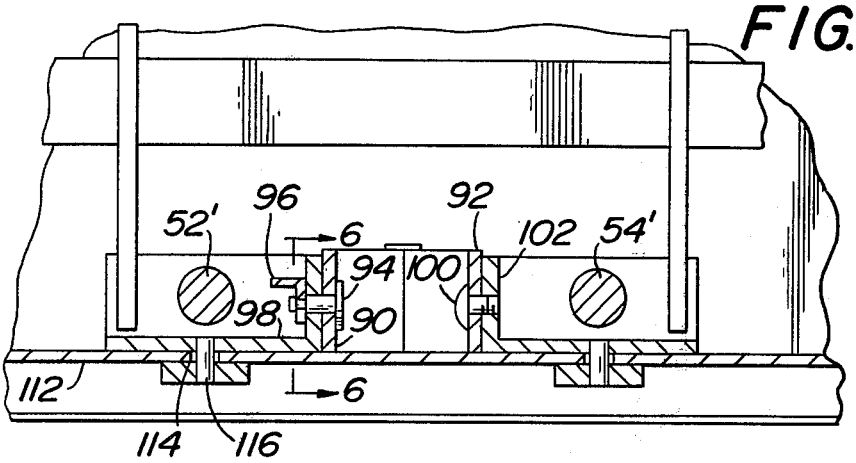
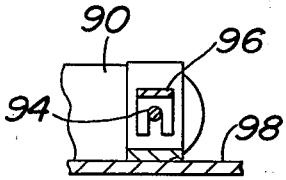
FIG. 6
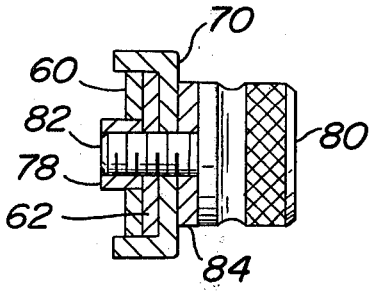
FIG. 7

VENDING MACHINE WITH CONVERTIBLE SHELVES

BACKGROUND

Vending machines are provided with shelves whose size correspond gennerally to the size of the product to be dispensed. If a machine is to be used for dispensing small bar-like products such as gum, candy bars and the like, the shelves are narrow. If the machine is designed to dispense wide bagged products such as potato chips and the like, the shelves are substantially wider than those used for bar-like products. There is a need for a vending machine which is selectively adjustable so as to handle narrow or wide products at the selection of the owner of the machine. The present invention is directed to a solution of that problem.

SUMMARY OF THE INVENTION

The present invention is directed to a coin operated vending machine. The machine housing contains horizontal pivotable shelves disposed side-by-side and adapted to support articles to be dispensed. A discrete dispensing operator for pivoting each shelf to effect dispensing is provided. A means is provided for converting two adjacent shelves so that they function as a single shelf. At the same time, the operator for one of the shelves is disabled. As a result thereof, the other operator can simultaneously effect dispensing from each of the interconnected shelves. Thus, the machine of the present invention facilitates dispensing narrow bar-like products on individual shelves and for converting adjacent shelves into a wide shelf for other types of products.

It is an object of the present invention to provide a vending machine with convertible shelves which may be used singularly or coupled together for simultaneous operation during a dispensing action.

It is another object of the present invention to provide a vending machine wherein adjacent horizontal disposed shelves may be coupled together for simultaneous movement in a manner which is simple, inexpensive and reliable.

Other objects will appear hereinafter.

For the purpose of illustrating the invention, there is shown in the drawings a form which is presently preferred; it being understood, however, that this invention is not limited to the precise arrangements and instrumentalities shown.

FIG. 4 is a view taken along the lines 4—4 in FIG. 2.

FIG. 5 is a view taken along the lines 5—5 in FIG. 3.

FIG. 6 is a view taken along the lines 6—6 in FIG. 5.

FIG. 7 is a view taken along the lines 7—7 in FIG. 3.

DETAILED DESCRIPTION

Figure 1:
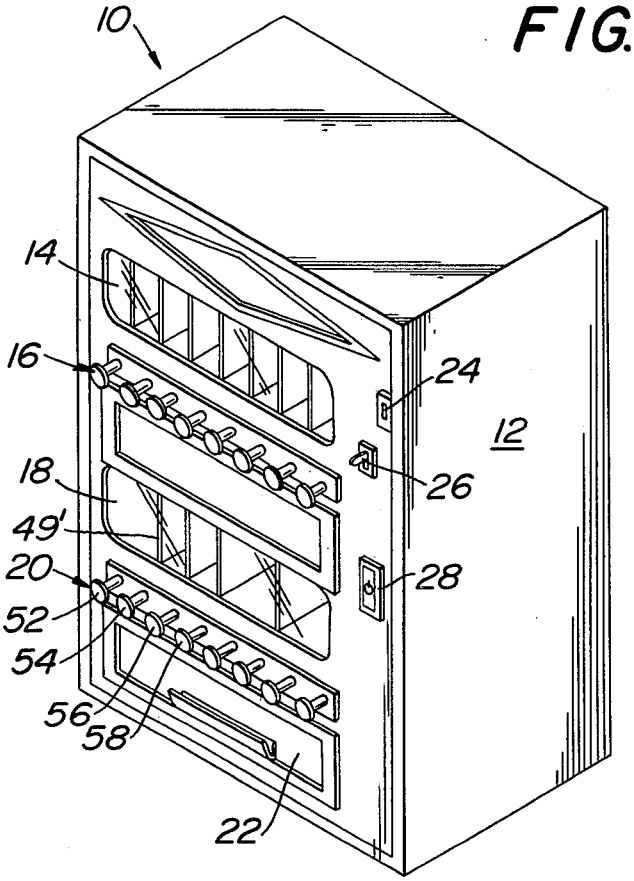
FIG. 1 is a perspective view of a vending machine in accordance with the present invention.

Referring to the drawings in detail, wherein like numerals indicate like elements, there is shown in FIG. 1 a coin operated vending machine in accordance with the present invention designated generally as 10. The machine 10 includes a conventional housing which may have its access door on the front wall or on the rear wall. The machine 10 is preferably a piggyback-type having an upper set of shelves for articles to be dispensed and a lower set of shelves for articles to be dispensed. Also, the machine 10 is preferably of the table or desk type in that it does not have legs and is not adapted to stand on the floor.

The front wall of the housing 12 is preferably provided with a row of display windows behind which are provided display compartments 14. Each display compartment contains a representation of a product on a vertical row of the upper set of shelves associated with one of the operator knobs in the row of knobs 16. A similar row of display compartments 18 is provided with an associated row of knobs 20 for the lower set of shelves. Thus, the products to be dispensed are not directly visible to the purchaser but rather a simulation thereof is provided in the display compartments. Each of the display compartments is partitioned off as a function of the size of the product to be dispensed. In FIG. 1, the size of the products to be dispensed by the row of knobs 20 is larger than the size of the products to be dispensed by the knobs of row 16. This is apparent from the greater number of partitions in the display compartments 14. The partitions are readily removable and are adjustable to the desires of the machine owner. The arrangement of partitions in the display compartments 14 and 18 matches the arrangement of removable partitions associated with each of the upper and lower sets of shelves. The individual shelves on each of the lower sets are all identical.

The machine 10 includes a front wall having at the lower end thereof a movable door to facilitate access to the dispensed product. The front wall also preferably includes a coin slot 24, a coin return lever 26, and a key actuated lock 28.

Figure 2:
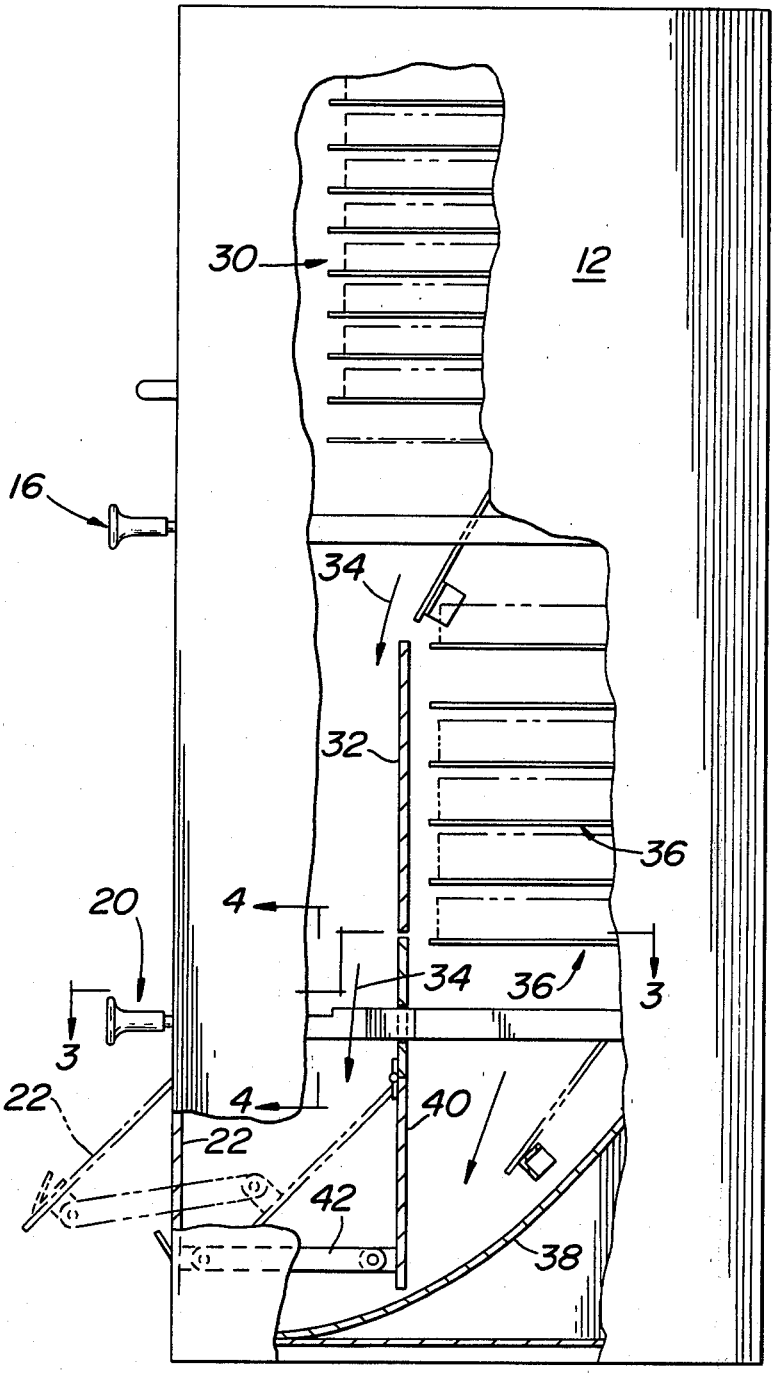
FIG. 2 is a side elevation view of the machine shown in FIG. 1 with portions broken away for purposes of illustration.

Referring to FIG. 2, there is provided an upper set 30 of horizontal rows of shelves containing products to be dispensed as a result of actuating one of the knobs of row 16. Each of the shelves of the upper set 30 are adapted to pivot downwardly during a dispensing action so that the product will follow the arrows 34 and fall downwardly through the space in front of the partition wall 32 for access at the chute 38. Access is attained by pulling on the handle of the door 22 which pivots about its upper end in a clockwise direction in FIG. 2.

The lower set 36 of shelves includes horizontally disposed rows of shelves in the same manner as described above. A dispensing action for a product on the sets 36 of shelves is attained by manipulating one of the knobs of row 20. The shelves of set 36 affect the dispensing action by pivoting downwardly. The products are discharged into the chute 38. A trap door 44 is attached to the lower edge of the partition wall 32 and pivots in a counterclockwise direction in FIG. 2. Doors 22 and 40 are interconnected by a connecting link 42.

Figure 3:
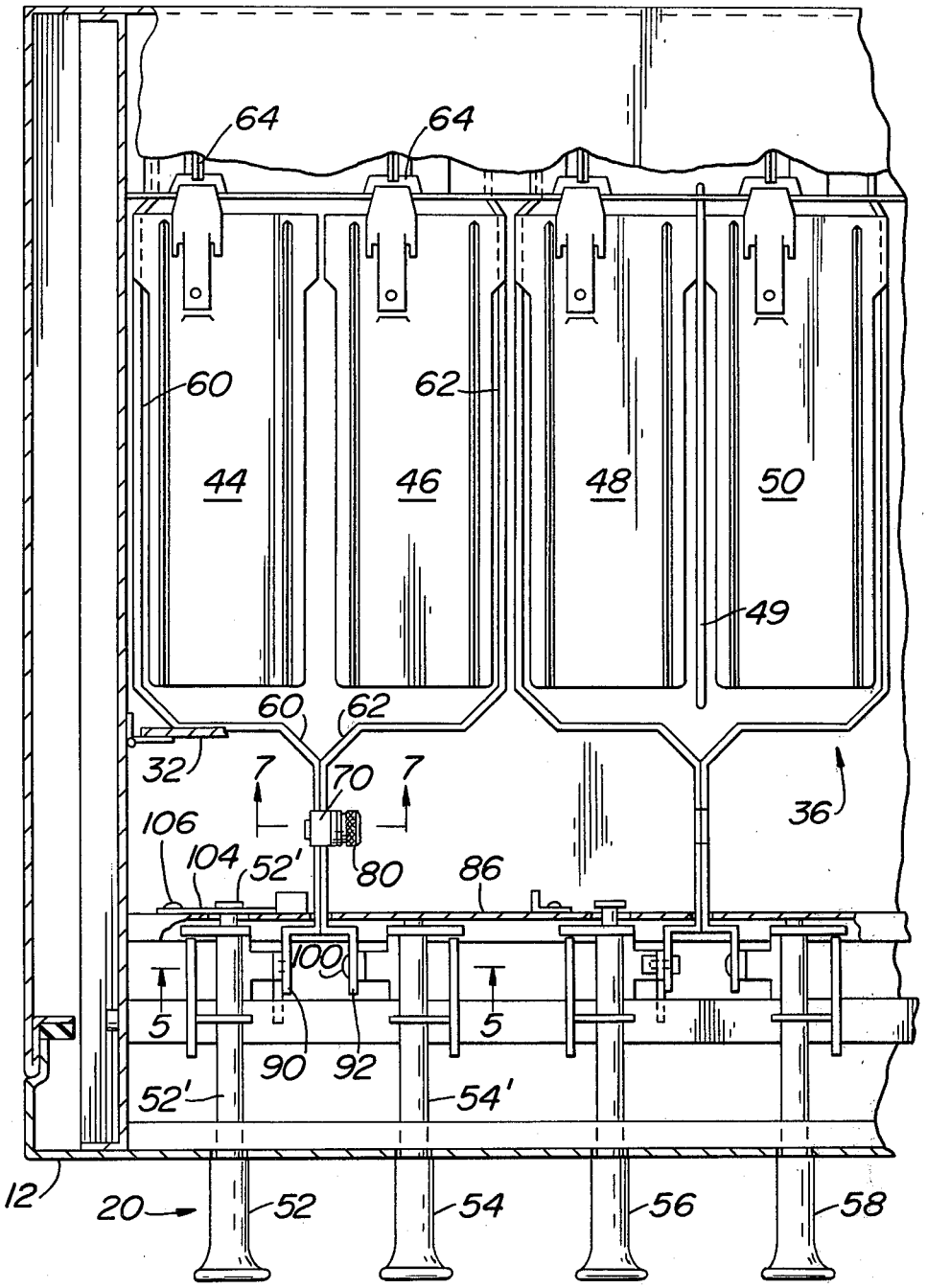
FIG. 3 is a view taken along the lines 3—3 in FIG. 2.

As mentioned above, each shelf in each row of each set 30, 36 of shelves is identical in size. Any shelf in any of the rows may be selectively coupled to the next adjacent shelf so as to double the size of the product which may be handled thereby. For purposes of illustration, reference is made to FIG. 3 where there is illustrated four shelves 44, 46, 48 and 50 constituting the first four shelves at the lefthand end of the second row of shelves of set 36. Shelves 44 and 46 have been modified in accordance with the present invention for simultaneous discharge. Shelves 48 and 49 remain isolated by a lane divider 49 for individual operation. The lane divider usually disposed between shelves 44 and 46 has been removed. The corresponding divider for the display compartment 18 has likewise been removed. The lane divider 49' on the display compartment 18 remains as shown in FIG. 1 since lane divider 49 has not been removed in FIG. 3.

An operator selection knob 52 is provided for shelf 44. A similar knob 54 is provided for shelf 46. A similar knob 56 is provided for shelf 48. A similar knob 58 is provided for shelf 50. The knobs are provided with a standard interlock mechanism which enables one knob to be operated at any given time. Such mechanism is not shown and is conventionally provided so as to prevent a customer from depositing coins in slot 24 and then simultaneously pulling two knobs.

An operator member 60 in the form of an angled bar extends from shaft 52' to the tilt mechanism 64 associated with shelf 44. A similar member 62 extends from the shaft 54' to a similar tilt mechanism 64 associated with shelf 46. The tilt mechanisms 44 are conventional. Bar members 60, 62 are shaped so as to have mating portions which are juxtaposed to one another as shown more clearly in FIGS. 3 and 8.

Figure 8:
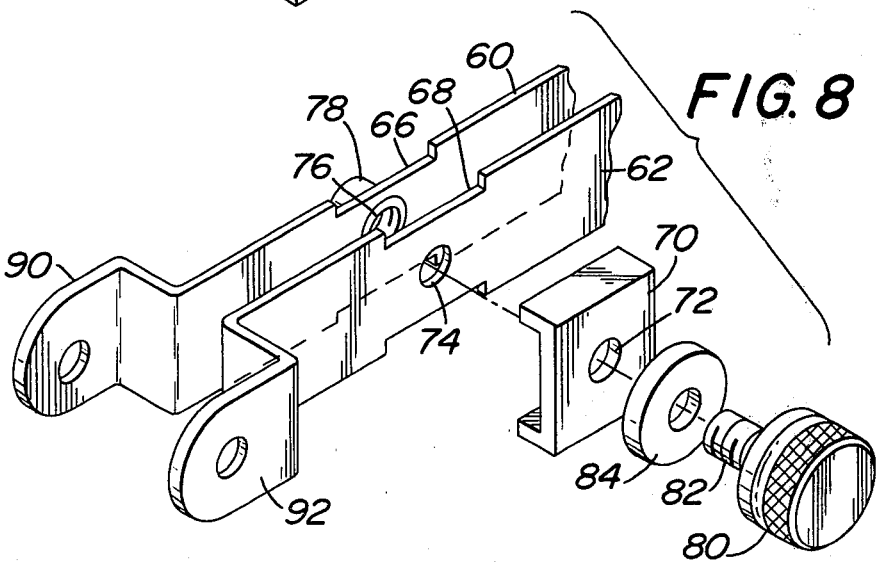
FIG. 8 is a partial perspective exploded view of the structure shown in FIG. 7.

Referring to FIG. 8, the juxtaposed portions of the members 60, 62 are provided with notches on their upper and lower surfaces. The notches on bar member 60 are designated 66 and the notches on bar member 62 are designated 68. A C-shaped clip 70 is provided. The legs of clip 70 are received within the notches 66, 68 while the bight of the clip 70 overlies one side face of the bar member 62. See FIG. 7.

Clip 70 has a hole 72 which is aligned with hole 74 in bar member 62 and hole 76 in bar member 60. A threaded boss 78 is attached to the bar member 60 coaxial with the hole 76. The threaded shank 82 on a knob 80 extends through the holes 72, 74 and 76 and is threaded to the boss 78. See FIG. 7. A lock washer 84 is preferably provided between the knob 80 and the bight of the clip 70. As a result of such structure, the clip 70 as well as the threaded shank 82 prevent relative movement between the juxtaposed portions of the bar members 60, 62 in a lengthwise direction which could trip the tilt mechanism 64.

The bar members 60, 62 extend through a slot 88 in a vertically disposed partition wall 86. See FIGS. 3 and 4. On the side of the wall 86 remote from the clip 70, the bar member 60 terminates in an offset tongue 90 while member 62 terminates in an offset tongue 92. As shown more clearly in FIG. 5, the tongue 90 is removably coupled to a bracket 98 by way of a removable pin 94 and locking clip 96. See FIGS. 5 and 6. Pin 94 and clip 96 are removed when shelves 44 and 46 are to be operated simultaneously and therefore such pin and clip are not shown in FIG. 3. Bracket 98 is connected to the shaft 52' for movement therewith. Hence, when pin 94 is removed, pulling on knob 52 will not cause any movement of bar member 60.

The tongue 92 on bar member 62 is secured to a bracket 102 by way of a threaded fastener 100. Bracket 102 is connected to the shaft 54'. Hence, pulling on knob 54 will result in bar members 60, 62 being reciprocated in a direction away from the shelves 44, 46 which will thereby trip the tilt mechanism 64 and cause both shelves to pivot downwardly and facilitate discharge of their contents to the chute 38.

While shaft 52' and its associated bracket 98 have been disconnected from the rod member 60, it is still necessary to prevent the customer from pulling on knob 52. As pointed out above, the interlock mechanism prevents two knobs from being pulled simultaneously. Accordingly, on partition wall 86 there is provided a movable latch 104. Latch 104 is preferably pivoted from an inoperative phantom position as shown in FIG. 4 to an operative position wherein notch 108 embraces a reduced diameter portion 110 on the shaft 52'. With the latch 104 in the solid line position shown in FIGS. 3 and 4, knob 52 cannot be pulled outwardly while knob 54 will cause a dispensing action from shelves 44 and 46 when pulled outwardly.

A mechanic may selectively and rapidly interconnect two adjacent shelves for simultaneous discharge of large products such as a bag of potato chips without interfering with adjacent shelves which can be operated individually. In order to convert from individual to multiple discharge, clip 70 and its associated components are attached to the juxtaposed portions of the rod members 60, 62 as shown in FIG. 7. Pin 94 and its clip 96 are removed. Latch 104 is pivoted to an operative solid line position as shown in FIG. 4. The partition between the shelves and the portion in the associated display compartment are removed. Conversion is now complete. If it is desired to revert back to individual shelf operation, pin 94 and clip 96 are attached as shown in FIGS. 5 and 6, latch 104 is moved to the phantom position shown in FIG. 4 and clip 70 is removed. The removed partitions are replaced. The components needed for conversion from single to multiple discharge or vice versa are few in number, simple, reliable and easy to install.

The knobs and their respective shafts are guided for horizontal reciprocation by wall 112 having a slot 114 for each of the shafts. See FIG. 5. Each of the brackets such as bracket 98 has a guide 116 extending through its associated slot.

The shelves of the upper set 30 and lower set 36 are all preferably interlocked electronically to operate from a single coin acceptor of conventional construction and which facilitates the use of different prices for different shelves. The machine 10 includes other conventional features such as switches, indicating lights, etc.

The present invention may be embodied in other specific forms without departing from the spirit or essential attributes thereof and, accordingly, reference should be made to the appended claims, rather than to the foregoing specification, as indicating the scope of the invention.

I claim

1. A vending machine comprising a housing containing horizontal pivotable shelves disposed side-by-side and adapted to support articles to be dispensed, a discrete dispensing operator coupled to each shelf for pivoting each shelf to attain a dispensing action, means for converting two adjacent shelves so that they function as a single shelf and for disabling one of the operators associated with said two adjacent shelves whereby the other operator can simultaneously effect dispensing from each of said two adjacent shelves.

2. A machine in accordance with claim 1 wherein said operators include bar members guided for horizontal reciprocation and having juxtaposed portions, and said means includes a latching device for fixedly securing said juxtaposed portions together, said means also including components for disconnecting said one operator from one of said bar members.

3. A machine in accordance with claim 1 wherein said means also includes a latch for latching said one operator so as to render it inoperative.

4. A machine in accordance with claim 2 wherein said bar members have mating notches, said means including a clip removably attached to said bar members and partially disposed within said notches.

5. A machine in accordance with claim 1 including removable partitions between adjacent shelves, said machine having a display compartment associated with each pair of shelves with a removable partition.

6. A coin operated vending machine comprising a housing containing an upper set of horizontal shelves and a lower set of horizontal shelves, each shelf being adapted to support articles to be dispensed, each shelf being mounted for downward pivotal movement about a horizontal axis to a dispensing position, a discrete dispensing operator coupled to each shelf for pivoting each shelf to its dispensing position, means for converting two adjacent shelves so that they function as a single shelf and for disabling one of the operators associated with said two adjacent shelves whereby the other operator can simultaneously effect dispensing from each of said two adjacent shelves, and a single chute for receiving articles from the shelves of each set for retrieval by a customer.

7. A machine in accordance with claim 6 wherein said operators include bar members guided for horizontal reciprocation and having juxtaposed portions, and said means includes a latching device for fixedly securing said juxtaposed portions together, said means also including a latch for latching said one operator so as to render it inoperative.

8. A machine in accordance with claim 7 wherein said bar members have mating notches, said means including a clip removably attached to said bar members and partially disposed within said notches.

* * * * *